US007726121B2

(12) United States Patent
Takahashi

(10) Patent No.: US 7,726,121 B2
(45) Date of Patent: Jun. 1, 2010

(54) ENGINE PART

(75) Inventor: Naohisa Takahashi, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 1099 days.

(21) Appl. No.: 11/197,631

(22) Filed: Aug. 4, 2005

(65) Prior Publication Data

US 2006/0026952 A1 Feb. 9, 2006

(30) Foreign Application Priority Data

Aug. 6, 2004 (JP) ..... 2004-230439

(51) Int. Cl.
*F01N 3/10* (2006.01)

(52) U.S. Cl. ..... 60/299; 60/272; 60/312; 60/322; 60/323; 60/324

(58) Field of Classification Search ..... 60/272, 60/299, 300, 312, 313, 322, 323, 324; 138/137, 138/138, 139, 143, 147, 149
See application file for complete search history.

(56) References Cited

U.S. PATENT DOCUMENTS

| | | | | | |
|---|---|---|---|---|---|
| 2,232,395 | A | * | 2/1941 | Koch, Jr. | 239/289 |
| 2,449,756 | A | | 9/1948 | Trautmann | |
| 2,697,670 | A | * | 12/1954 | Gaudenzi et al. | 428/212 |
| 3,009,238 | A | | 11/1961 | Wesley et al. | |
| 3,404,750 | A | * | 10/1968 | Powers et al. | 181/228 |
| 3,488,723 | A | * | 1/1970 | Veazie | 252/62 |
| 3,500,954 | A | * | 3/1970 | Willette | 181/232 |
| 4,607,722 | A | * | 8/1986 | Tanaka et al. | 181/252 |
| 4,702,968 | A | * | 10/1987 | Masuhara et al. | 428/623 |
| 5,246,786 | A | | 9/1993 | Usui | |
| 5,269,905 | A | | 12/1993 | Reynolds | |
| 5,783,622 | A | * | 7/1998 | Sabata et al. | 524/444 |
| 6,139,022 | A | * | 10/2000 | Iwashita et al. | 277/443 |

FOREIGN PATENT DOCUMENTS

| | | |
|---|---|---|
| DE | 926 580 | 4/1955 |
| DE | 1 496 930 | 12/1969 |
| DE | 39 34 112 A1 | 5/1990 |
| DE | 195 42 313 A1 | 6/1996 |

(Continued)

OTHER PUBLICATIONS

European Search Report dated Dec. 9, 2005, issued in the corresponding European Patent Application No. 05017075.2-2119.

(Continued)

*Primary Examiner*—Binh Q. Tran
(74) *Attorney, Agent, or Firm*—Keating & Bennett, LLP

(57) ABSTRACT

An engine part has a construction which prevents the surface discoloration/deterioration associated with a high-temperature exhaust gas, irrespective of the type of Cr used in the formation of a chromium plating layer (hexavalent chromium or trivalent chromium). The engine part includes a metal substrate, a chromium plating layer covering at least a region of a surface of the metal substrate, the region being heated to a temperature of about 350° C. or more, and an intermediate plating layer provided between the metal substrate and the chromium plating layer. The chromium plating layer has a thickness of about 0.2 μm or more in the region.

30 Claims, 7 Drawing Sheets

FOREIGN PATENT DOCUMENTS

| | | | | |
|---|---|---|---|---|
| EP | 0 147 484 | | | 7/1985 |
| EP | 1 010 777 | A2 | | 6/2000 |
| FR | 1 284 763 | | | 1/1962 |
| FR | 1.350.959 | | | 1/1964 |
| FR | 2 583 070 | A1 | | 12/1986 |
| GB | 2 188 942 | A | | 10/1987 |
| GB | 2 294 949 | A | | 5/1996 |
| JP | 58207375 | A | * | 12/1983 |
| JP | 09-228069 | | | 9/1997 |
| JP | 3073789 | | | 6/2000 |
| JP | 2000-328939 | | | 11/2000 |
| JP | 2003-013752 | | | 1/2003 |
| JP | 2003-041933 | | | 2/2003 |
| JP | 2003-232219 | | | 8/2003 |
| JP | 2003-254095 | | | 9/2003 |
| JP | 2003-254096 | | | 9/2003 |
| JP | 2003-277976 | | | 10/2003 |

OTHER PUBLICATIONS

Official communication issued in counterpart European Application No. 05 017 075.2, mailed on Aug. 5, 2008.

* cited by examiner

ENGINE PART

BACKGROUND OF THE INVENTION

1. Field of the Invention

The present invention relates to an engine part, and more particularly, the present invention relates to an engine part which is subjected to a high temperature due to a high-temperature exhaust gas discharged from an engine.

2. Description of the Related Art

In a vehicle such as a motorcycle or an all-terrain four-wheeled vehicle, not only the performance of the vehicle itself, but a good vehicle design are vital. FIG. 10 is a side view showing an example of a sports-type motorcycle. A motorcycle 200 shown in FIG. 10 includes a V-type engine 201 and an exhaust pipe 202 for guiding along exhaust gas. The V-type engine 201 includes cylinders 203, cylinder heads 204, and head covers 205. The aesthetically excellent V-type engine 201 is likely to be mounted to the motorcycle such that the engine is exposed on the outside, and is highly influential to the exterior appearance of the entire motorcycle.

The two cylinders 203 of the V-type engine 201 are united at the single exhaust pipe 202, which extends toward and above the rear wheel so as to allow exhaust gas to be discharged at the rear portion of the body. The exhaust pipe 202 must have a certain thickness for allowing the exhaust gas generated in the engine 201 to be efficiently discharged. Moreover, the portion constituting a muffler 202*a* has an increased diameter in order to accommodate the muffling structure. For these reasons, the exhaust pipe accounts for a relatively large part of the exterior appearance of the entire motorcycle, and thus the shape and color of the exhaust pipe are highly influential to the entire motorcycle design.

In the present specification, engine components such as the cylinders 203, the cylinder heads 204, the head covers 205, as well as the exhaust pipe 202 for guiding the exhaust gas from the engine, will be generally referred to as "engine parts". For the aforementioned reasons, the shape and color of engine parts are important factors in determining the entire motorcycle design.

Conventionally, those engine parts which show up on the exterior appearance are subjected to surface treatments such as plating to acquire a lustrous metallic color, thus to enhance the engine part design. Above all, decorative chromium plating has been widely used for engine parts because it is possible to give the plated material a characteristic, lustrous silver-gray color (see, for example, Japanese Laid-Open Patent Publication No. 2003-41933).

Since decorative chromium plating provides an excellent metallic luster, and also excels in anticorrosiveness, it is also used in various fields other than engine parts. In order to obtain excellent exterior appearance and anticorrosiveness, it is unnecessary to provide a thick layer of decorative chromium plating. In fact, a thick layer of decorative chromium plating will result in a poor color tone and surface finish. Therefore, in general, decorative chromium plating is likely to be used at a thickness in the range from 0.1 μm to 0.15 μm.

On the other hand, hard chromium plating (industrial chromium plating) is also widely used as Cr plating in industrial products. Since hard chromium plating provides a low friction coefficient and an excellent abrasion resistance, it is used for sliding sections of various machine parts, for example. Since abrasion resistance is a requirement, hard chromium plating is usually formed to a thickness of at least several μm. Moreover, hard chromium plating does not provide a decorativeness surface as does decorative chromium plating. Generally, decorative chromium plating provides a surface roughness (Ra) of about 1 μm or less (typically, about 0.2 μm or less), while hard chromium plating provides a surface roughness of more than about 1 μm.

In such engine parts, due to the high-temperature exhaust gas generated from the engine, the surface of the chromium plating layer may change its color tone to result in a violet discoloration, or the decorative chromium plating layer may have cracks and then peel. Particularly in recent years, the engine performance has improved, and catalysts have been used for exhaust gas purification, and as a result the exhaust gas temperature has increased. Thus, engine parts are becoming more susceptible to discoloration due to high-temperature exhaust gas. As described above, engine parts account for a relatively large portion of the overall exterior appearance of the entire motorcycle. Therefore, even a muddy spot on the chromium plating may greatly impair the entire design.

This problem may be addressed by preventing the temperature of the surface of the exhaust pipe or the like from becoming too high, by adopting a two-fold or three-fold cylindrical structure for the exhaust pipe, for example. However, even by adopting a two-fold or three-fold cylindrical structure, the temperature of the exhaust pipe surface will not be adequately lowered, and surface oxidation or deterioration due to heat will not be completely prevented. Moreover, in this case, there is another problem in that the outer dimensions of the exhaust pipe or the like are increased.

It might be possible to prevent discoloration or deterioration of an engine part surface by covering the exhaust pipe (for example) with a cowl or a protector so that the exhaust pipe will not show on the exterior. However, in this case, the exhaust pipe no longer contributes to the entire motorcycle design, thus making it difficult to pursue the characteristic beauty of a motorcycle. In particular, covering an exhaust pipe with a protector will result in a diameter which is greater than the exhaust pipe itself, thus worsening layout constraints.

A decorative chromium plating layer is usually formed by using a chromate, including hexavalent chromium ($Cr^{6+}$). Hexavalent chromium is inexpensive. A decorative chromium plating layer obtained by using hexavalent chromium shows good contact with a base substrate, and has excellent anticorrosiveness and abrasion resistance. A chromium plating layer obtained by using hexavalent chromium has a silver-gray color with a characteristically metallic luster. Therefore, hexavalent chromium is widely used in engine parts for motorcycles, for example. However, its toxic nature has been recognized in the recent years. Hence, proposals have been made to use trivalent chromium ($Cr^{3+}$), instead of hexavalent chromium, to obtain decorative chromium plating. Although trivalent chromium is inferior to hexavalent chromium in terms of anticorrosiveness, contact with the base substrate, and the like, environmental pollution concerns and safety-oriented thinking have led to the trends toward selective use of trivalent chromium. The trend for such alternative plating, i.e., trivalent chromium replacing hexavalent chromium, is also becoming popular in the field of engine parts. For example, a motorcycle having a trivalent chromium-plated protector provided on the outer periphery of a muffler has recently been developed.

However, according to the studies by the inventor, discoloration of the plating layer and surface deterioration due to a high-temperature heating are observed even in the case where trivalent chromium is used, and in fact, such discoloration and deterioration are more noticeable than in the case where hexavalent chromium is used.

Furthermore, a decorative chromium plating layer obtained by using trivalent chromium has a slightly blackish color tone. This presents a new problem in that the silver-gray color tone obtainable by using hexavalent chromium is difficult to obtain. Such a difference in color tone can be highly problematic in the field of motorcycles and the like, where exterior appearance is regarded as important. Therefore, there is a desire for engine parts which, even by using trivalent chromium, attain a similar color tone to that which is obtained by using hexavalent chromium.

SUMMARY OF THE INVENTION

In order to overcome the problems described above, preferred embodiments of the present invention provide engine parts which prevent the surface discoloration/deterioration associated with a high-temperature exhaust gas, irrespective of the type of Cr used in the formation of a chromium plating layer (hexavalent chromium or trivalent chromium). Also, preferred embodiments of the present invention also provide engine parts which, even by using trivalent chromium, attain a similar color tone to that which is obtained by using hexavalent chromium.

An engine part according to a preferred embodiment of the present invention includes a metal substrate, a chromium plating layer covering at least a region of a surface of the metal substrate, the region being heated to a temperature of about 350° C. or more, and an intermediate plating layer provided between the metal substrate and the chromium plating layer, wherein the chromium plating layer has a thickness of about 0.2 μm or more in the region.

In a preferred embodiment of the present invention, the chromium plating layer has a thickness in a range from about 0.2 to about 0.9 μm in the region.

In a preferred embodiment of the present invention, the chromium plating layer has a thickness in a range from about 0.2 to about 0.5 μm in the region.

In a preferred embodiment of the present invention, the metal substrate is a metal tube defining a passage through which an exhaust gas from an engine travels.

In a preferred embodiment of the present invention, the chromium plating layer covers an outer side surface of the metal tube.

In a preferred embodiment of the present invention, the metal tube has a bent portion, and the region is a convex surface formed as a result of the bending of the bent portion.

In a preferred embodiment of the present invention, the metal tube includes a manifold section having a plurality of branch pipes connected thereto, and the region is an outer surface of the manifold section.

In a preferred embodiment of the present invention, the metal tube has a catalyst accommodating section accommodating a catalytic apparatus for decomposing at least one component in the exhaust gas, and the region is an outer surface of the catalyst accommodating section.

In a preferred embodiment of the present invention, the chromium plating layer includes decorative chromium plating.

In a preferred embodiment of the present invention, the intermediate plating layer includes at least one of C and S.

In a preferred embodiment of the present invention, the intermediate plating layer also includes Ni.

In a preferred embodiment of the present invention, the intermediate plating layer includes a metal having a hardness lower than that of a type of Cr composing the chromium plating layer.

In a preferred embodiment of the present invention, the intermediate plating layer includes nickel plating.

In a preferred embodiment of the present invention, the metal substrate is composed of a material containing Fe, Al, Zn, Mg, or Ti as a main component.

In a preferred embodiment of the present invention, the chromium plating layer is formed by using a hexavalent chromium plating bath.

In a preferred embodiment of the present invention, the chromium plating layer is formed by using a trivalent chromium plating bath.

Alternatively, an engine part according to a preferred embodiment of the present invention includes a metal substrate, a chromium plating layer covering at least a portion of a surface of the metal substrate, and an intermediate plating layer provided between the metal substrate and the chromium plating layer, wherein a type of Cr composing the chromium plating layer substantially has an amorphous structure, and an Fe content in the chromium plating layer is about 2 mass % or less.

In a preferred embodiment of the present invention, the chromium plating layer has a color tone such that an L* value measured according to CIE (Commision Internationale de l'Eclairage) 1976 is in a range from 68 to 80.

In a preferred embodiment of the present invention, the chromium plating layer covers a region of the surface of the metal substrate, the region being heated to a temperature of about 350° C. or more, and the chromium plating layer has a thickness in a range from about 0.2 μm to about 0.6 μm in the region.

In a preferred embodiment of the present invention, the metal substrate is a metal tube defining a passage through which an exhaust gas from an engine travels.

In a preferred embodiment of the present invention, the chromium plating layer covers at least a portion of an outer side surface of the metal tube.

In a preferred embodiment of the present invention, the metal tube has a bent portion, and the region is a convex surface formed as a result of the bending of the bent portion.

In a preferred embodiment of the present invention, the metal tube includes a manifold section having a plurality of branch pipes connected thereto, and the region is an outer surface of the manifold section.

In a preferred embodiment of the present invention, the metal tube has a catalyst accommodating section accommodating a catalytic apparatus for decomposing at least one component in the exhaust gas, and the region is an outer surface of the catalyst accommodating section.

In a preferred embodiment of the present invention, the chromium plating layer includes decorative chromium plating.

In a preferred embodiment of the present invention, the intermediate plating layer includes at least one of C and In a preferred embodiment of the present invention, the intermediate plating layer also includes Ni.

In a preferred embodiment of the present invention, the intermediate plating layer includes a metal having a hardness lower than that of a type of Cr composing the chromium plating layer.

In a preferred embodiment of the present invention, the intermediate plating layer includes nickel plating.

In a preferred embodiment of the present invention, the metal substrate is composed of a material containing Fe, Al, Zn, Mg, or Ti as a main component.

An engine according to another preferred embodiment of the present invention includes any of the aforementioned engine parts according to preferred embodiments described above.

An exhaust pipe according to yet another preferred embodiment of the present invention includes a metal tube having a bent portion, and a decorative chromium plating layer arranged to cover at least an outer convex surface being formed as a result of the bending of the bent portion, the decorative chromium plating layer having a thickness of about 0.2 μm or more.

In a preferred embodiment of the present invention, the metal tube includes a manifold section having a plurality of branch pipes connected thereto, and a catalyst accommodating section accommodating a catalytic apparatus, and the decorative chromium plating layer further covers an outside of the manifold section and the catalyst accommodating section.

In a preferred embodiment of the present invention, the chromium plating layer has a thickness in the range from about 0.2 to about 0.5 μm.

In a preferred embodiment, the chromium plating layer has a color tone such that an L* value measured according to CIE (Commision Internationale de l'Eclairage) 1976 is in a range from 68 to 80.

A transportation apparatus according to another preferred embodiment of the present invention includes any of the aforementioned exhaust pipes according to preferred embodiments described above.

A method of producing an engine part according to a further preferred embodiment of the present invention includes the steps of placing a metal substrate in a plating apparatus; forming an intermediate plating layer on the metal substrate, and using a chromium plating bath, performing plating while placing the metal substrate with the intermediate plating layer formed thereon in such a manner that a chromium plating layer having a thickness of about 0.2 μm or more is formed in a region of a surface of the metal substrate, the region being heated to a temperature of about 350° C. or more.

In a preferred embodiment of the present invention, an Fe content in the chromium plating layer is suppressed to about 2 mass % or less by controlling an Fe content in the chromium plating bath to be substantially zero.

In a preferred embodiment of the present invention, the chromium plating bath does not contain any additive having an Fe component.

In a preferred embodiment of the present invention, Fe contained in the chromium plating bath is removed by using a cation exchange resin.

In accordance with an engine part of a preferred embodiment of the present invention, the thickness of a chromium plating layer is appropriately controlled in a region which is heated to a high temperature, so that discoloration of the plating layer due to heating can be prevented. Moreover, since the Fe content in the chromium plating layer is reduced drastically, a chromium plating layer formed by using trivalent chromium attains a silver-gray color tone similar to that which is obtained by using hexavalent chromium, thus providing excellent luster. Moreover, since the Fe content is reduced drastically, the chromium plating layer has a high anticorrosiveness, and prevents rust.

Other features, elements, processes, steps, characteristics and advantages of the present invention will become more apparent from the following detailed description of preferred embodiments of the present invention with reference to the attached drawings.

DETAILED DESCRIPTION OF PREFERRED EMBODIMENTS

Figure 1:
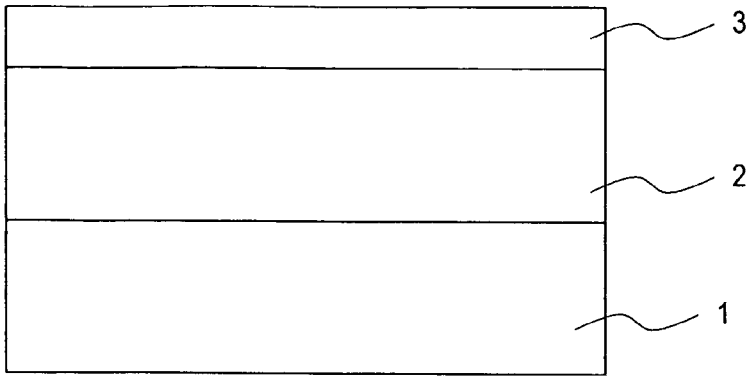
FIG. 1 is a diagram schematically showing the structure of an engine part according to a preferred embodiment of the present invention.

The inventor has sought engine parts which can prevent discoloration of a decorative chromium plating layer and surface deterioration associated with a high-temperature exhaust gas. As used herein, "discoloration" of a chromium plating layer refers to a change in the color of the surface of the plating layer from silver-gray to blue or violet. The inventor has also sought engine parts which, even when a decorative chromium plating layer is formed thereon by using trivalent chromium, attain a color tone similar to that of a chromium plating layer which is obtained by using hexavalent chromium. Typically, a decorative chromium plating is accompanied with an intermediate plating layer which is present between the chromium plating layer and a base substrate, in order to achieve an enhanced contact with the base substrate. Accordingly, the inventor's study has been directed to engine parts having such a structure. In the following, decorative chromium plating will simply be referred to as "chromium plating".

As a result, it has been found that the surface discoloration of the chromium plating layer is mainly attributable to the fact that the C (carbon) and/or S (sulfur) which is supplied from the intermediate plating layer diffuses due to heating, and gathers near the interface between the intermediate plating layer and the chromium plating layer so as to thicken (thus forming a "C—S thickened layer"). It has also been determined that, in the case where a nickel plating layer is formed as an intermediate plating layer, the Ni which is contained in the nickel plating layer also joins the aforementioned C and S elements to form a "C—S—Ni thickened layer", thus contributing to the surface discoloration of the chromium plating layer. According to a detailed study by the inventor, the elements which have thickened in the plating cause a change in the refractive index and/or light absorption (with respect to incident light) of the chromium plating. Presumably, the discoloration caused by such a change is more conspicuous than the interference colors caused by the usually-occurring oxide coating on the outermost surface of a chromium plating layer.

The inventor has looked for a method of preventing such surface discoloration, and thus found that the unfavorable influence of the "C—S thickened layer" or "C—S—Ni thickened layer" can be minimized at least by controlling the thickness of a portion of the chromium plating layer that is heated by the high-temperature exhaust gas so as to be within a predetermined range greater than a conventional thickness, because the increased thickness of the chromium plating layer prevents the light entering the chromium plating layer from reaching the thickened layer.

Furthermore, the main cause for the blackish color tone of a chromium plating layer obtained by using trivalent chromium has been found to be the Fe which is contained in the chromium plating layer. This has led to the finding that, by minimizing the Fe content in the chromium plating layer, a chromium plating layer obtained by using trivalent chromium is able to attain a color tone similar to that which is obtained by using hexavalent chromium. Moreover, through a CASS (Copper-Accelerated Acetic Acid Salt Spray) text, it has been confirmed that anticorrosiveness is improved by reducing the Fe content. It has also been confirmed that rust is prevented as a result of the above.

Hereinafter, with reference to FIG. 1, the structure of an engine part according to a preferred embodiment of the present invention will be described. As shown in FIG. 1, the engine part according to a preferred embodiment of the present invention preferably includes a metal substrate 1, a chromium plating layer 3 covering the surface of the metal substrate 1, and an intermediate plating layer 2 provided between the metal substrate 1 and the chromium plating layer 3. The chromium plating layer covers at least a region of the surface of the metal substrate 1 that is to be heated to a temperature of about 350° C. or more. Hereinafter, the aforementioned constituent elements will be individually described.

1. Metal Substrate

The metal substrate 1, which has a mechanical strength suitable to its purpose and a necessary level of anticorrosiveness and the like, can be formed from a material which is usually used for an engine part. A typical example would be an Fe-type material. Otherwise, the metal substrate 1 may be formed from any non-Fe material, such as an Al-type material, a Zn-type material, an Mg-type material, or a Ti-type material.

Examples of Fe-type materials include Fe or steels whose main component is Fe, such as: steel tubes for machine structural purposes (e.g., carbon steel tubes for machine structural purposes (STKM) or alloy steels for machine structural purposes); stainless steel (e.g., ferrite-type stainless steel, austenite-type stainless steel, or austenite/ferrite-type stainless steel); and mild steel (e.g., SPCC or SPHC). Examples of Al-type materials include: Al; and Al alloys such as Al—Si alloys or Al—Si—Mg-type alloys. Examples of Zn-type materials include: Zn; Zn-plated steel plates, on which a Zn plating layer is provided; and Zn alloy-plated steel plates, on which a Zn alloy plating layer whose main component is Zn and which includes alloying elements such as Ni, Co, Cr, or Al is provided. Examples of Mg-type materials include Mg—Al type alloys and Mg—Zn type alloys. Examples of Ti-type materials include: Ti; and Ti alloys whose main component is Ti and which includes elements such as Al, V, or Si.

These materials have different characteristics depending on their types. For example, Al is light-weight and shiny, whereas Ti is light weight and has excellent mechanical strength. Therefore, any appropriate material may be selected depending on the purpose, required characteristics, and the like.

2. Intermediate Plating Layer

The intermediate plating layer 2 formed on the metal substrate 1 defines a an underlying plating for the chromium plating layer 3. As mentioned above, in the case of chromium plating, an intermediate plating layer is usually formed under the chromium plating layer in order to realize good contact with the base substrate. Therefore, it is preferable that the intermediate plating layer exhibits good contact with various metal substrates, as well as good contact with the chromium plating layer. There might be other preferable characteristics of the intermediate plating layer, e.g., anticorrosiveness, and so on.

The metal composing the intermediate plating layer 2 used for preferred embodiments of the present invention can be defined in terms of a relationship with the hardness (Vickers hardness) of Cr, which in itself is used for forming the chromium plating layer. Specifically, it is preferable that the metal composing the intermediate plating layer 2 is formed of a metal having a hardness lower than the hardness of Cr (about 400 Hv to about 1200 Hv). The presence of a layer composed of a low-hardness metal interposed between the chromium plating layer and the metal substrate reduces the stress applied to the chromium plating layer due to heat cycles. As a result, the generation of cracks and the like is prevented, and a chromium plating layer having good surface characteristics can be obtained. Examples of metals having a lower hardness than that of Cr include Ni (hardness: about 150 Hv to about 400 Hv), Cu (hardness: about 40 Hv to about 250 Hv), Sn (hardness: about 20 Hv to about 200 Hv), and Pb (whose hardness is immeasurable).

As an intermediate plating layer including such metals, for example, a layer composed of nickel plating, Cu plating, Sn plating, Pb plating, Zn-nickel plating, or the like is preferably used. A single such plating layer may be formed, or two or more kinds may be combined to result in there being a plurality of intermediate plating layers. Alternatively, a plurality of intermediate plating layers of the same kind but containing different types of additives, etc., may be formed. A typical intermediate plating layer to be used as the underlying layer for a chromium plating layer is nickel plating, which further enhances anticorrosiveness, luster, and the like. The details of nickel plating will be described later.

The intermediate plating layer 2 includes elements which compose various additives. With the purpose of enhancing the luster of the chromium plating layer, such additives are added in a plating bath for forming the intermediate plating layer 2. Specifically, a primary brightener (a non-butyne-type brightener, e.g., saccharin sodium, naphthalene-1,3,6-trisodium trisulfonate, or benzene sulfonic acid), a secondary brightener (e.g., 2-butyl-1,4-diol, sodium allylsulfonate), and the like are preferably used. Any such additive preferably includes C and/or S as its component elements. Although depending on the type of intermediate plating layer and the type of additive, a total of about 0.001 mass % to about 1.0 mass % of C and/or S is preferably included in the intermediate plating layer. As will be specifically described later, these elements will thicken to about 0.1 mass % to about 10 mass % responsive to heating, thus causing surface discoloration of the chromium plating layer. Furthermore, in the case where the intermediate plating layer 2 is a nickel plating layer, the Ni contained in the nickel plating layer also substantially affects surface discoloration.

Hereinafter, nickel plating will be specifically described as a typical example of an intermediate plating layer. Nickel plating is generally classified into lusterless nickel plating, semigloss nickel plating, and gloss nickel plating, mainly depending on the type of brightener added in the plating bath, whether such an addition is made or not, etc. These types of plating can be appropriately combined in accordance with the required characteristics, purpose, and the like, whereby the desired exterior appearance can be obtained.

Gloss nickel plating is obtained by adding a brightener such as saccharin or benzene sulfonic acid to the plating bath. Gloss nickel plating provides an excellent surface leveling (planarize) action and exhibits good contact with the chromium plating layer, and therefore is widely used as an underlying layer to be formed directly under a chromium plating layer. A brightener for gloss nickel plating is usually used in an amount such that a total of about 0.001 mass % to about 1.0 mass % of at least one of C and S is included in the plating layer. Anticorrosiveness tends to decrease as the S content increases.

Lusterless nickel plating differs from gloss nickel plating in that no brightener is contained in the plating bath. Although providing less luster than gloss nickel plating, lusterless nickel plating is excellent in terms of throwing power, anticorrosiveness, discoloration prevention, etc., of the plating layer. It is to be noted that the "throwing power" refers to the ability to form uniform layer of plating metal.

Semigloss nickel plating is obtained by adding a non-coumarin-type semi-brightener to the plating bath. Unlike the aforementioned brighteners, semi-brighteners have little C and/or S content. Therefore, semigloss nickel plating provides better anticorrosiveness but poorer luster than those provided by gloss nickel plating.

In general, when a number of nickel plating layers containing different amounts of S are formed on top of one another, potential differences will emerge between the plating layers, so that coatings having greater S contents are corroded first. By utilizing this property, it is common to use two or more layers of nickel plating to provide improved anticorrosiveness. For example, in the case of a two-layer plating obtained by sequentially forming a semigloss nickel plating layer and a gloss nickel plating layer upon a base metal, the gloss plating layer is corroded first because of having a lower potential than that of the semigloss plating layer. As a result, the base metal under the semigloss plating layer is protected without being corroded. In order to further enhance anticorrosiveness in the aforementioned two-layer plating structure, a tri-nickel plating layer (which is a type of gloss nickel plating layer) having a large S content may be formed between the semigloss nickel plating layer and the gloss nickel plating layer, thus obtaining a three-layer plating structure. The S contained in the tri-nickel plating layer is most often supplied from an additive other than a brightener. In this case, the uppermost gloss nickel plating layer is corroded first, and then the intermediate tri-nickel plating layer is corroded, whereby both the semigloss nickel plating layer and the base metal are protected.

In order to effectively utilize such actions of nickel plating, the nickel plating layer(s) preferably has a total thickness of about 10 μm to about 30 μm, and more preferably no less than about 15 μm and no more than about 25 μm.

In the case where an intermediate plating layer other than a nickel plating layer is to be formed, the intermediate plating layer is preferably controlled to a thickness of about 10 μm to about 30 μm.

3. Chromium Plating Layer

On the intermediate plating layer 2, the chromium plating layer 3 is formed. There are no particular limitations as to the type of Cr used for forming the chromium plating layer 3, and either trivalent chromium or hexavalent chromium may be used. In other words, the chromium plating layer 3 may be formed by trivalent chromium plating or hexavalent chromium plating.

Figure 2A:
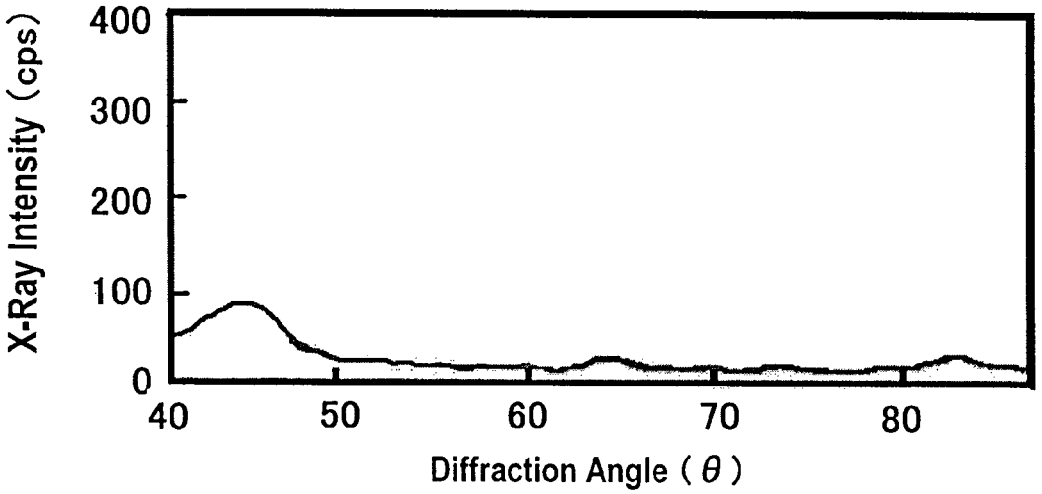
FIG. 2A is a graph showing X-ray diffraction analysis results of a chromium plating layer formed by using trivalent chromium.
Figure 2B:
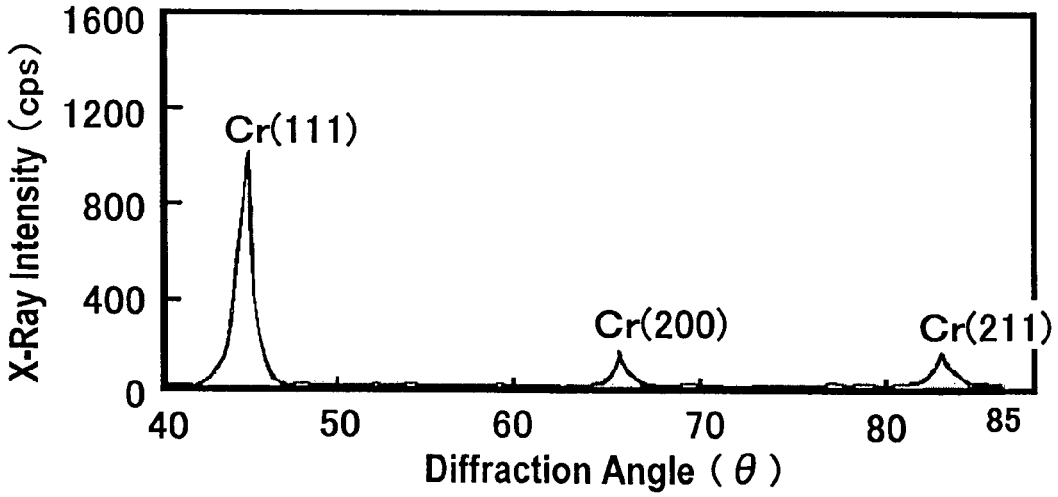
FIG. 2B is a graph showing X-ray diffraction analysis results of a chromium plating layer formed by using hexavalent chromium.

Which type of Cr has been used to form a particular chromium plating layer can be easily determined by subjecting the chromium plating layer to an X-ray diffraction analysis. FIGS. 2A and 2B each show X-ray diffraction analysis results of a chromium plating layer. The detailed measurement method was as follows.

Analysis equipment: X-ray diffraction apparatus RAD-3C type (Rigaku Corporation)

Measurement conditions: A Cu anticathode was used, and power was supplied at about 40 kV/40 mA.

X-ray diffraction results of a chromium plating layer which has been formed by using hexavalent chromium are shown in FIG. 2B. Near diffraction angles of about 40θ to 50θ, a very large diffraction peak of about 1200 cps is observed, and large diffraction peaks of about 200 cps are observed near diffraction angles of about 65θ and about 83θ. In the ascending order of diffraction angles, these peaks correspond to (111) orientation crystal, (200) orientation crystal, and (211) orientation crystal, respectively.

On the other hand, X-ray diffraction results of a chromium plating layer which has been formed by using trivalent chromium are shown in FIG. 2A. Only a small diffraction peak of about 100 cps is observed near diffraction angles of about 40θ to 50θ, this corresponding to (111) orientation crystal. A value obtained by dividing the half-width of the peak corresponding to (111) orientation crystal by the peak intensity (half-width/peak height) is about 0.6 rad/cps, which is much broader than the value of (111) orientation crystal (about $7.9\times10^{-4}$ rad/cps) which is observed when using hexavalent chromium.

From FIGS. 2A and 2B, it can be seen that the chromium plating layer obtained by using hexavalent chromium has a crystal structure composed of polycrystals, whereas the chromium plating layer obtained by using trivalent chromium has a substantially amorphous structure. The determination as to whether a plating layer has a crystalline structure or an amorphous structure can be made by checking, for example, whether a diffraction peak associated with a (half-width/peak height) value of about 0.001 rad/cps or less is observed or not near diffraction angles of about 40θ to 50θ.

In the case where a chromium plating layer is to be formed by using trivalent chromium, it is preferable to reduce the Fe content in the chromium plating layer as much as possible. As a result, a color tone similar to that which is obtained by using hexavalent chromium can be obtained even by using trivalent chromium. The reason for this, although not clearly known to the inventor, is presumably that the Fe which is contained in the additives (such as ferrous sulfate) to be introduced to the trivalent chromium plating bath would bind to various elements and produce black Fe-type deposits, for example.

Since the deterioration of color tone due to the use of trivalent chromium will be more aggravated as the Fe content increases, the Fe content in the chromium plating layer should be kept as small as possible. In order to obtain a color tone similar to that which is obtained by using hexavalent chromium, it is preferable to reduce the Fe content in the chromium plating layer to 2 mass % or less. The Fe content is more preferably 1 mass % or less, and still more preferably 0.5 mass % or less; the smaller the Fe content, the better the results will be.

A chromium plating layer which is thus obtained will have a color tone such that an L* value as measured in the following manner is in the range from 68 to 80. The L* value is to be calculated by a method described in CIE 1976, by using a spectrometric color difference meter (e.g., color analyzer TC-1800MK-II (Tokyo Denshoku)).

The Fe content in the chromium plating layer can be determined by analyzing the Fe content in the chromium plating layer along the depth direction (0 to 1 μm), by using a GDS analysis technique (Glow Discharge Spectrometry).

4. Mechanism of Discoloration Prevention

The engine part according to various preferred embodiments of the present invention is characterized in that a chromium plating layer which is present in a region of the metal substrate surface that is to be heated to a temperature approximately of 350° C. or more has a thickness of about 0.2 μm or more. Conventionally, the thickness of the entire chromium plating layer, including the portion which is exposed to high temperature, is not more than about 0.1 μm. On the other hand, according to preferred embodiments of the present invention, at least a portion of the chromium plating layer which is susceptible to surface discoloration/deterioration due to a high-temperature exhaust gas is formed so as to be thick. Therefore, adverse effects associated with the formation of a "C—S thickened layer", e.g., discoloration, can be minimized.

Hereinafter, the reason why discoloration of the chromium plating layer due to heating can be prevented by controlling the thickness of the chromium plating layer will be described with reference to FIG. 3 and FIGS. 4A and 4B.

Figure 3:
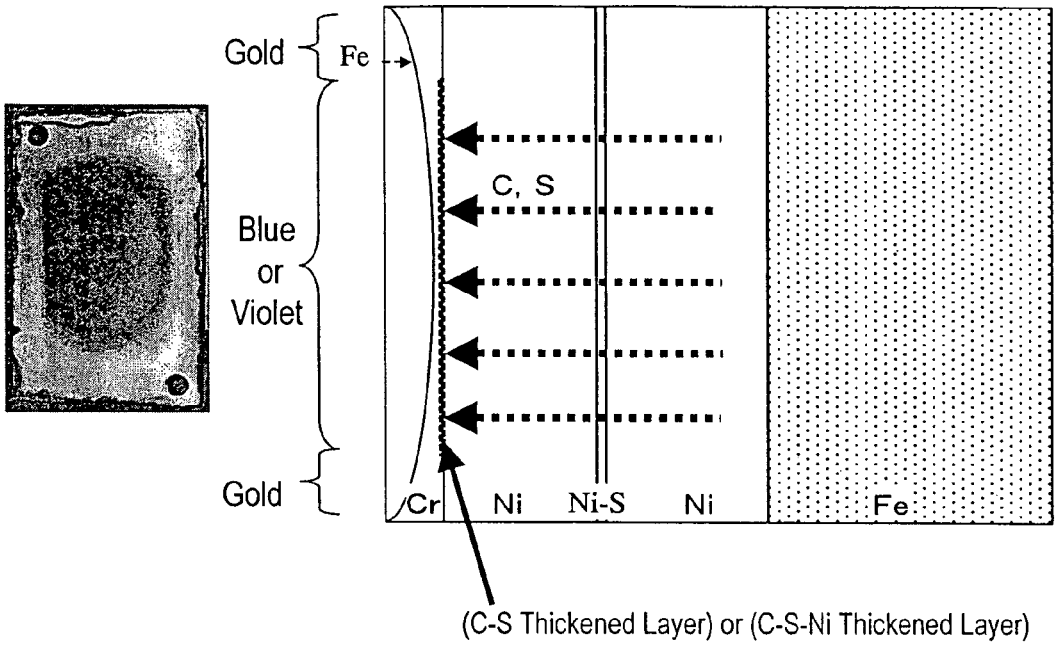
FIG. 3 is a diagram schematically showing the generation of a "C—S thickened layer" or a "C—S—Ni thickened layer", obtained by heating, near an interface between a chromium plating layer and an intermediate plating layer.

FIG. 3 is a diagram schematically showing a manner in which C and/or S gather near the interface between the chromium plating layer and the intermediate plating layer responsive to heating, thus showing a generation mechanism of a "C—S thickened layer" or a "C—S—Ni thickened layer" (hereinafter may be collectively referred to as a "thickened layer"), which is considered as responsible for the surface discoloration of the chromium plating layer. FIG. 3 illustrates a typical structure according to a preferred embodiment of the present invention, in which a nickel plating layer is formed between an Fe substrate and a chromium plating layer. The nickel plating layer is composed of the following three sublayers, respectively from the Fe substrate side: a semigloss nickel plating layer, a tri-nickel plating layer, and a gloss nickel plating layer.

Note that, responsive to heating, various elements which compose the additives contained in the chromium plating layer and/or the nickel plating layer will gather near the interface between the chromium plating layer and the nickel plating layer. FIG. 3 only shows those elements which are considered as contributive to the discoloration of the chromium plating layer, i.e., the elements (at least one of C, S, and Ni) composing the aforementioned thickened layer and elements (e.g., Fe or Cr) which are likely to bind to these elements, while omitting any other elements (e.g., O which gathers near the aforementioned interface responsive to heating).

As shown in FIG. 3, mainly C or S moves from the nickel plating layer side to the chromium plating layer side, thus gathering at the aforementioned interface. As described earlier, C or S is mainly the element which composes a non-butyne-type brightener (e.g., benzene sulfonic acid) which is added to the nickel plating bath. In particular, a large amount of S is contained in the gloss nickel plating layer and the tri-nickel plating layer. Therefore, near the aforementioned interface, a "C—S thickened layer" in which a large amount of C or S has gathered is formed. As used herein, a "C—S thickened layer" means a layer in which at least one of C and S has gathered. Note that, although C or S may also diffuse over from the chromium plating layer side, such diffusion will account for a very small proportion as compared to the diffusion from the nickel plating layer side, and therefore is omitted from illustration.

In the case where the intermediate plating layer is a nickel plating layer, a "C—S—Ni thickened layer" containing Ni will be formed. Similarly to C or S, Ni is also considered as contributive to discoloration. As used herein, a "C—S—Ni thickened layer" means a layer in which at least one of C or S and Ni has gathered.

Although not clearly known to the inventor, the reason why formation of such a thickened layer causes surface discoloration of the chromium plating layer may be that the Cr composing the chromium plating layer may bind to the element (C or S, or Ni) composing the thickened layer and change the refractive index of the chromium plating layer, thus causing discoloration, for example. In the case where trivalent chromium is used to form a chromium plating layer, the Fe which is mainly supplied from the ferrous sulfate or the like that is added to the trivalent chromium plating bath is also considered as a substance that contributes to discoloration. In the case where the metal substrate is composed of an Fe-type material, responsive to heating, Fe may diffuse from the Fe-type material and become thickened in the area of the aforementioned interface (not shown).

Surface discoloration of the chromium plating layer associated with such a thickened layer can be prevented by forming the thickness of the chromium plating layer to be about 0.2 μm or more. Hereinafter, the reason thereof will be described with reference to FIGS. 4A and 4B.

Figure 4A:
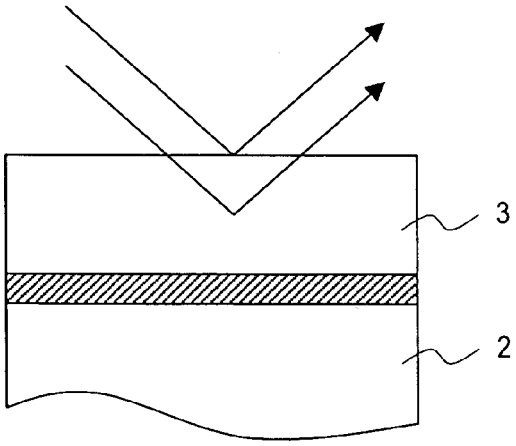
FIG. 4A is a schematic diagram for explaining prevention of discoloration of a chromium plating layer by increasing the thickness of the chromium plating layer.
Figure 4B:
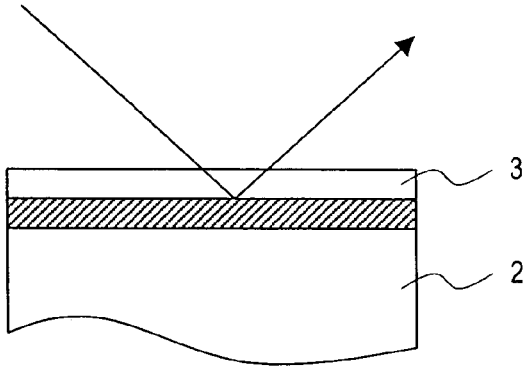
FIG. 4B is a diagram schematically showing a portion of a conventional Cr-nickel plating layer.

FIG. 4B is a diagram schematically showing a portion of a conventional Cr-nickel plating layer. As shown in FIG. 4B, the thickness of the conventional chromium plating layer is as small as about 0.1 μm or less. Therefore, incident light will be transmitted to the area of the interface between the chromium plating layer and the nickel plating layer. Consequently, a portion of the incident light will be absorbed by the thickened layer which is generated near the interface, thus making the discoloration due to heating more conspicuous.

On the other hand, by prescribing the thickness of the chromium plating layer to be 0.2 μm or more, as shown in FIG. 4A, the incident light will for the most part be reflected near the surface of the chromium plating layer, instead of being transmitted over to the area of the interface between the chromium plating layer and the nickel plating layer. Therefore, only the interference colors caused by the usually-occurring oxide coating on the outermost surface of a chromium plating layer are observed, and the influence due to the thickened layer can be minimized.

In order to allow such action to be effectively exhibited, the thickness of the chromium plating layer is set to be about 0.2 μm or more. From the perspective of prevention of thermal discoloration due to heating, there is no particular upper limit to the thickness of the chromium plating layer. However, if the thickness of the chromium plating layer exceeds about 0.9 μm, coarse surface or other problems may newly occur, and in particular, the luster will deteriorate. Moreover, cracks will become more likely to occur at the surface. The preferable thickness range may be determined by taking all such facts into account. Specifically, the thickness of the chromium plating layer is preferably not less than about 0.2 μm and not more than about 0.9 μm, and more preferably not less than about 0.3 μm and not more than about 0.5 μm, although this depends on the heating conditions, the type of Cr (whether hexavalent chromium or trivalent chromium), etc. In particular, in the case of using trivalent chromium, luster deterioration and crack generation responsive to heating to about 350° C. or above become more outstanding than in the case of using hexavalent chromium. Therefore, in this case, the thickness of the chromium plating layer is preferably not less than about 0.3 μm and not more than about 0.5 μm.

The thickness of the chromium plating layer 3 may be measured through observation with an optical microscope (magnification: ×400). Specifically, a cross section along the thickness direction of the plating layer is mirror-polished and etched. As a result, the chromium plating layer becomes clearly distinguishable from the intermediate plating layer. Note that the chromium plating layer will have a surface roughness Ra of not more than about 0.01 μm, and therefore the influence of the surface roughness Ra on the thickness of the chromium plating layer is virtually negligible. Since the thickness of the chromium plating layer will slightly vary depending on the measurement site, a total of three measurements are to be taken in different measurement sites within a given a field of observation, and an average value thereof is to be defined as the "thickness of the chromium plating layer".

Another means for preventing discoloration due to the formation of a thickened layer might be to reduce the C or S content, although this method would not be practical. For example, in order to reduce the C or S content, the amount of brightener to be contained in the intermediate plating layer would mainly have to be reduced. However, this would result in a reduced luster, and thus considerably impair the design of the engine part. When good design is considered as an important factor as in the case of the present invention, any deterioration in design because of not using the brightener must definitely be avoided.

In order to prevent discoloration due to heating, it will suffice if a portion of the chromium plating layer 3 which is to be heated to a temperature of about 350° C. or above satisfies the aforementioned range of thickness. In other words, it is not necessary that the entire area of the chromium plating layer 3 formed on the metal substrate 1 satisfy the aforementioned range of thickness. In regions which will only rise to a temperature of less than about 350° C., the thickness of the chromium plating layer 3 may be less than about 0.2 μm. In general, a chromium plating layer is tinted from silver-gray to yellow to gold responsive to heating, and at a high temperature of about 350° C. to about 500° C., becomes discolored from gold to violet. Such changes in color tone will not be uniformly observed over the entire area in which the chromium plating layer is formed, but will be most noticeable in portions which are likely to be exposed to a high-temperature exhaust gas. Therefore, in order to prevent discoloration from gold to violet, it will be sufficient to control the thickness of the portion at which discoloration due to heating is most likely to occur, i.e., the region of the chromium plating layer that is exposed to a temperature of about 350° C. or above, to be in the aforementioned range.

Examples of the "region which is to be heated to a temperature of about 350° C. or above" may include a portion of an engine part composing an engine, e.g., a cylinder, a cylinder head, a head cover, as well as a portion of an exhaust pipe defining a channel for guiding the exhaust gas discharged from the engine. As used herein, the "exhaust pipe" may be an exhaust pipe which directly guides exhaust gas, or an exhaust pipe (a double tube) which is indirectly heated by exhaust gas. An "exhaust pipe" includes a manifold section for guiding along the exhaust gas from each cylinder, a catalytic apparatus accommodating section covering a catalytic apparatus, a muffler, and the like.

5. Engine Part Structure

Figure 5:
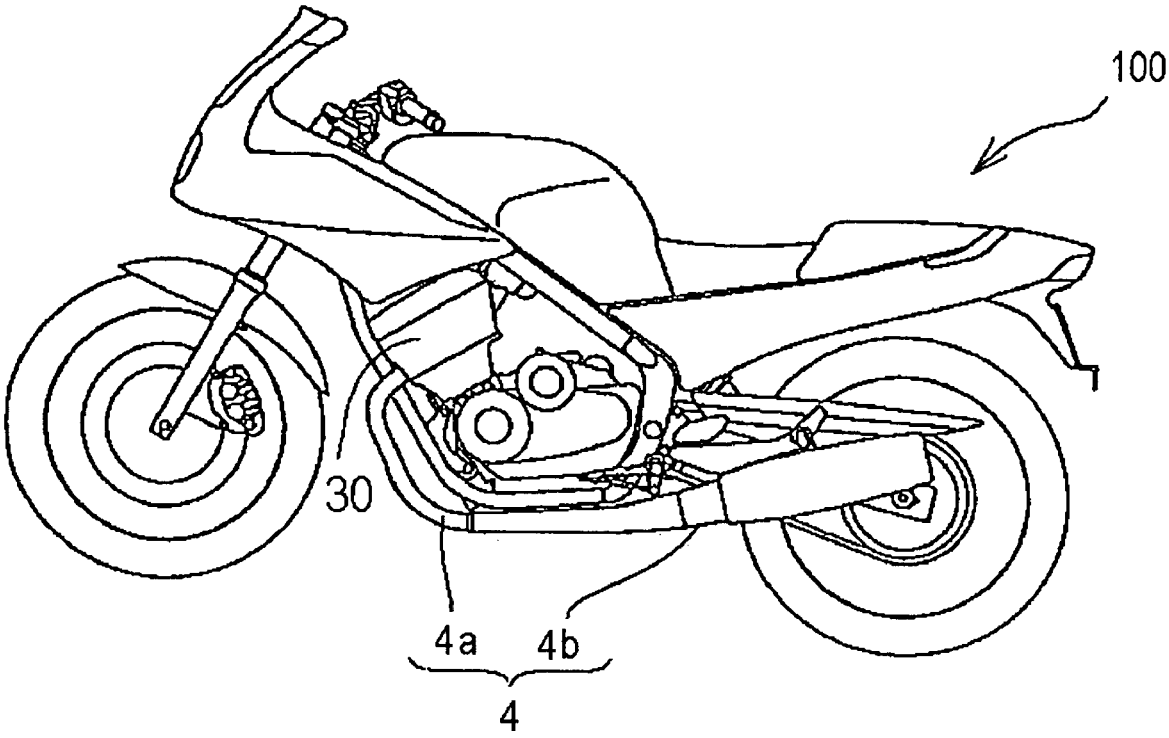
FIG. 5 is a side view showing a motorcycle in which an engine part according to a preferred embodiment of the present invention is used.
Figure 10:
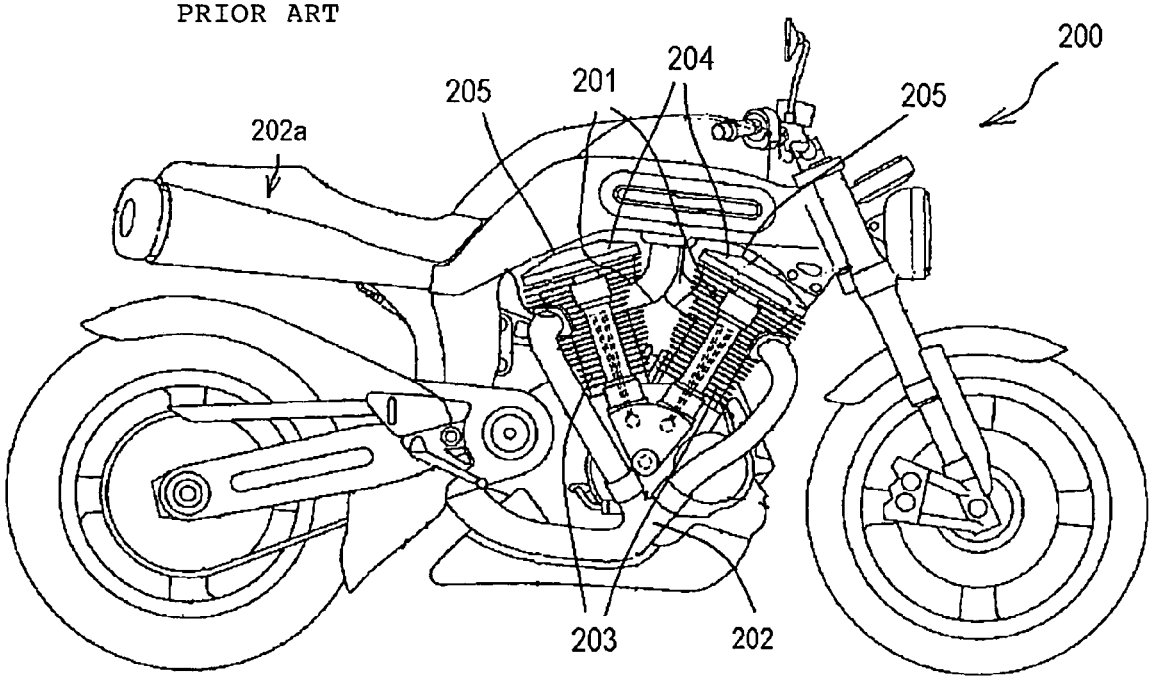
FIG.10 PRIOR ART
FIG. 10 is a side view showing the exterior appearance of a motorcycle.

With reference to FIG. 5, a specific structure of the engine part according to a preferred embodiment of the present invention will be described. FIG. 5 shows a motorcycle 100 incorporating an exhaust pipe which is an engine part according to a preferred embodiment of the present invention. As shown in FIG. 5, the motorcycle 100 includes an engine 30 and an exhaust pipe 4 for guiding the exhaust gas generated in the engine 30 so as to be discharged at the rear portion of the body. The exhaust pipe 4 preferably includes a exhaust pipe congregation section 4*a*, which is connected to the engine 30 and constitutes a substantially bent exhaust path for allowing the exhaust gas having been discharged at the front of the engine 30 to be guided toward the rear, and a muffler 4*b*. The exhaust pipe congregation section 4*a* may be integrally formed of a single part, or composed of a plurality of parts which are connected with one another. In the present preferred embodiment, the exhaust pipe 4 is entirely exposed so as to appear on the exterior of the motorcycle 100, thus constituting a part of the design of the motorcycle 100 as a whole. As will be specifically described below, the unique effect of preferred embodiments of the present invention, i.e., discoloration of the exhaust pipe 4 is prevented and the fresh exterior appearance of a brand-new motorcycle is retained for long periods of time, is more clearly enhanced in the case where the entire exhaust pipe 4 is exposed. However, as long as the exhaust pipe 4 at least partially appears on the exterior, another part of the exhaust pipe 4 may be covered by a cowl or a protector, depending on the design of the motorcycle. Moreover, the shape of the motorcycle for which the exhaust pipe is used is not limited to that shown in FIG. 5. For example, the exhaust pipe according to preferred embodiments of the present invention may be adopted in a motorcycle having a structure as shown in FIG. 10.

Next, with reference to FIGS. 6A, 6B, and 6C, specific examples of the "region of the metal substrate surface that is to be heated to a temperature of about 350° C. or above", on which a chromium plating layer having a thickness of about 0.2 μm or more is to be formed according to preferred embodiments of the present invention, will be described. Each of these figures is a cross-sectional view showing a part of the exhaust pipe 4.

Figure 6A:
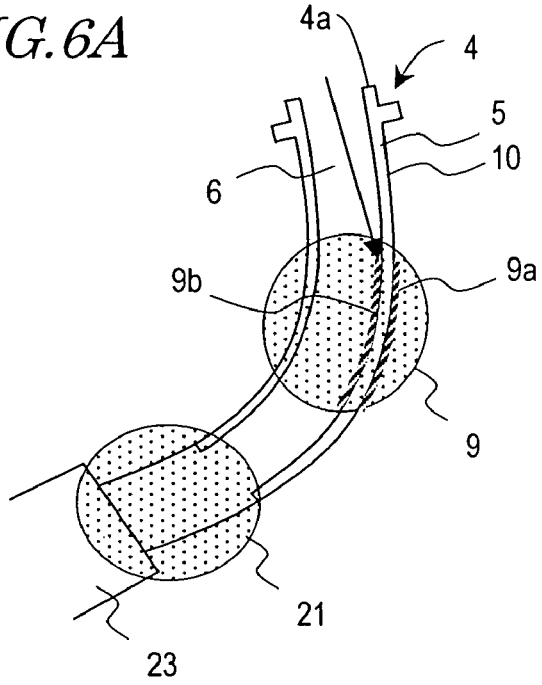
FIG. 6A is a diagram schematically showing a portion of an exhaust pipe which is directly connected to an engine.

FIG. 6A shows an exhaust pipe congregation section 4*a* of the exhaust pipe 4, which is directly connected to an engine. As shown in FIG. 6A, the exhaust pipe congregation section 4*a*, which is connected to an engine (not shown), includes a metal tube 5 defining a passage 6 in which exhaust gas travels through, and a plating layer 10 covering the outer side surface of the metal tube 5. The metal tube 5 includes a bent portion 9. The bent portion 9 is a portion at which the passage 6 is bent, or a portion at which the longitudinal direction of the passage 6 changes.

As described above, the plating layer 10 preferably includes an intermediate plating layer and a chromium plating layer. The metal tube 5 simply needs to define the passage 6, and may have a double-tube structure composed of an inner tube defining the passage 6 and an outer tube covering the inner tube from the outside.

The exhaust gas that comes through the exhaust pipe congregation section 4*a*, which is directly connected to the engine (not shown), rapidly travels through the passage 6, and therefore collides against the metal tube 5 at the bent portion 9. The exhaust gas collides especially intensely against an inner side surface 9*b* of the metal tube 5 that is located at the convex surface portion 9*a* (which in itself is formed as a result of the bending). Therefore, the outer convex surface portion 9*a* is heated by the high-temperature exhaust gas to a temperature of about 350° C. or more (e.g., about 400 to 500° C.).

In the case where the metal tube 5 has a double-tube structure, a single-tube structure is often adopted for a link section 21 at which another exhaust pipe member 23 is to be connected. The reason is that, if a double-tube structure were adopted at the link section 21, the metal tube 5 might deform or be destroyed due to a difference in thermal expansion (between the outer tube and the inner tube) during the welding to the other exhaust pipe member 23. If the metal tube 5 is of such a structure, the link section 21 will be heated to a temperature of about 350° C. or more (e.g., about 400° C. to about 500° C.) as the high-temperature exhaust gas comes in direct contact with the inner side surface of the link section 21.

Figure 6B:
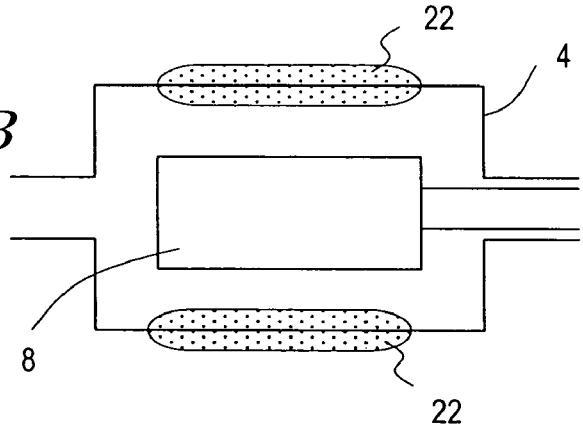
FIG. 6B is a diagram schematically showing a cross section of a catalyst accommodating section of an exhaust pipe.

FIG. 6B schematically shows a cross section of a catalyst accommodating section 22 of the exhaust pipe 4, in which a catalytic apparatus 8 is accommodated. The catalytic apparatus 8 which is provided within the catalyst accommodating section 22, decomposes at least one component contained in the exhaust gas when the exhaust gas travel therethrough. Since the catalytic apparatus 8 is heated responsive to the aforementioned decomposition, the catalyst accommodating section 22 is heated to a temperature of about 350° C. or more (e.g., about 400° C. to 500° C.).

In the case where the engine 30 (FIG. 5) has a plurality of cylinders, the exhaust pipe 4 may include a manifold section for combining the exhaust gas generated in the respective cylinders so as to allow all such exhaust gas to be guided to the rear portion of the motorcycle 100. FIG. 6C shows an exhaust pipe 4 having a manifold section 15 at which branch pipes 4*d* and 4*e* (each of which is connected to a cylinder) come together, such that discharge takes place through a unified exhaust pipe member 4*f*. At such a manifold section 15 of the exhaust pipe congregation section 4*a*, exhaust gas comes together through the plurality of branch pipes 4*d* and 4*e*, whereby the flow rate of the exhaust gas is increased, and the flow paths are deflected. As a result, the exhaust gas collides against the inner side surface of the manifold section 15. Therefore, the manifold section 15 is heated by the exhaust gas to a temperature of about 350° C. or more (e.g., about 400° C. to about 500° C.).

Figure 6C:
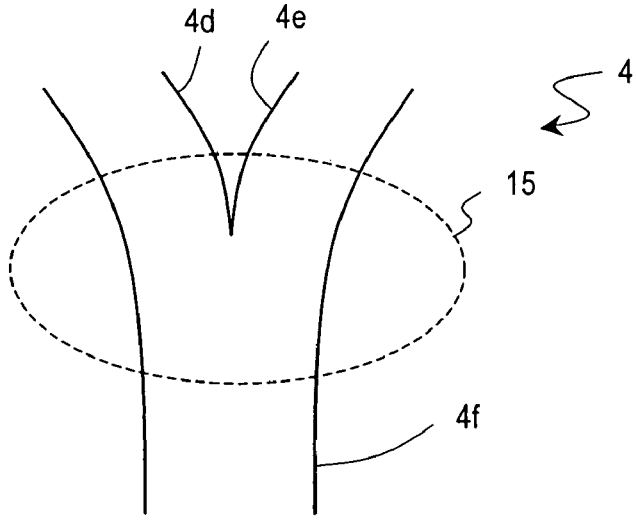
FIG. 6C is a diagram schematically showing a cross section of a manifold section.

In the motorcycle of the present preferred embodiment, those portions of the exhaust pipe which are exemplified as being heated to a high temperature in FIGS. 6A, 6B, and 6C are preferably covered from the outside by a chromium plating layer of about 0.2 μm or more. As a result, even when exposed to a high-temperature exhaust gas, discoloration of the chromium plating layer due to the heating can be prevented.

In the case of using a chromium plating layer which is formed by using trivalent chromium, the Fe content in the chromium plating layer is reduced. As a result, an excellent color tone similar to that which is obtained by using hexavalent chromium can be expressed.

The present invention also encompasses a transportation apparatus incorporating the above-described engine part(s) according to other preferred embodiments of the present invention. Examples of transportation apparatus include a vehicle having an engine (e.g., a motorcycle or an all-climate four-wheeled vehicle) and a transportation apparatus having an engine (e.g., a marine vessel or an airplane).

6. Method of Producing the Engine Part

Next, a method for producing an engine part according to a preferred embodiment of the present invention will be described. The method for producing an engine part according to a preferred embodiment of the present invention includes a step of placing a metal substrate in a plating apparatus, a step of coating the metal substrate with an intermediate plating layer, and a step of, by using a chromium plating bath, plating the metal substrate having the aforementioned intermediate plating layer formed thereon, in such a manner that a chromium plating layer of about 0.2 μm or more is formed in any region which is to be heated to a temperature of about 350° C. or above.

First, in order to degrease and clean the surface of a metal substrate, a metal substrate is immersed in a bath such as a water rinse bath, ultrasonic wave alkaline degreasing bath, electrolytic degreasing bath, or acid treatment activation bath for a predetermined period of time. As a result of this, the surface of the metal substrate is sufficiently degreased, thus making it easy to form an intermediate plating layer and a chromium plating layer on the metal surface.

Next, by using the metal substrate thus washed, an electroplating is conducted to sequentially form an intermediate plating layer and a chromium plating layer at least on the outer surface of the metal substrate. Electroplating occurs based on the following principle. As a cathode, a material to be plated (i.e., a material on which plating is to be formed) is placed in a plating solution containing ions of a metal which will constitute the plating. The metal which will constitute the plating is also used as a soluble anode. A DC power source is connected between the electrodes and power is applied therefrom. As a result, ions of the metal which will constitute the plating are reduced at the cathode side, thus resulting in a metal deposit. Both the intermediate plating layer and the chromium plating layer are to be formed through electroplating, based on the same principle. Therefore, in the following description, only the step of forming the chromium plating layer will be described with specific reference to the plating apparatus shown in FIG. 7, whereas the step of forming the intermediate plating layer will be described without referring to any figures.

The intermediate plating layer is formed by immersing the aforementioned metal substrate in a plating trough containing a solution of a metal which will constitute the plating, and applying power until reaching a desired thickness. For example, in the case where three nickel plating layers, namely a semigloss nickel plating layer, a tri-nickel plating layer, and a gloss nickel plating layer, are to be formed as the intermediate plating layer, the metal substrate which has been washed in the aforementioned manner is immersed in a semigloss nickel plating bath, a tri-nickel plating bath, and a gloss nickel plating bath, and power is applied until the respective desired plating layers are obtained. The specific plating conditions will depend on the metal substrate to be used, plating bath composition, purpose, and the like. The conditions which are usually used for Ni-chromium plating can be selected as appropriate. For example, in the case where a semigloss nickel plating layer (about 5 μm to about 15 μm), a tri-nickel plating layer (about 1 μm to about 2 μm), and a gloss nickel plating layer (about 5 μm to about 15 μm) are to be sequentially formed on an Fe substrate, it is preferable to control the temperature of the plating bath to be about 40° C. to about 65° C., and the pH of the plating bath to be about 2 to 5. The plating time is preferably about 10 to 20 minutes for semigloss nickel plating as well as gloss nickel plating, and about 1 to 5 minutes for tri-nickel plating.

Next, a chromium plating layer is formed on the metal substrate which has been subjected to intermediate plating. A chromium plating apparatus 20 shown in FIG. 7 preferably includes a chromium plating trough 11 in which to perform chromium plating, a pump 12 for pumping up a plating solution which has been introduced to the chromium plating trough 11, a percolator 13 for removing impurities which are suspended in the plating solution, an adjustment valve 14 for adjusting the flow rate of the plating solution, and a flowmeter 15 for monitoring the flow rate of the plating solution. On the downstream end of the chromium plating apparatus 20, an ion exchange apparatus 16 for removing the metal ions (such as Fe) contained in the plating solution is provided. The chromium plating apparatus 20 and the ion exchange apparatus 16 are connected to each other via a metal tube (not shown).

Depending on the type of Cr composing the chromate, either a hexavalent chromium bath or a trivalent chromium bath is used for the chromium plating trough 11. A hexavalent chromium bath and a trivalent chromium bath differ mainly in terms of chromate type, and otherwise in terms of the types and amounts of other additives to be introduced to the baths. Since trivalent chromium is inferior to hexavalent chromium in terms of anticorrosiveness and contact with the base substrate, many additives are usually added to a trivalent chromium bath. For example, a trivalent chromium bath includes not only basic chromium sulfate ($Cr(OH)SO_4$) having trivalent chromium ions ($Cr^{3+}$), but also a pH adjuster such as ammonium formate ($HCOONH_4$) or boric aid ($H_3BO_4$). Furthermore, small amounts of additives such as a surfactant (e.g., sodium sulfosuccinate, sulfate-2-sodium ethylhexyl) and ferrous sulfate ($FeSO_4.2H_2O$) are also added. On the other hand, a hexavalent chromium bath generally includes not only chromic anhydride ($CrO_3$) containing hexavalent chromium ions ($Cr^{6+}$), but also an additive such as sulfuric acid ($H_2SO_4$) or sodium silicofluoride ($Na_2SiF_6$). Usually, ferrous sulfate and boric aid are not added to a hexavalent chromium bath. In other words, a chromium plating layer obtained by using hexavalent chromium contains substantially no Fe or B.

The chromium plating is to be carried out via electroplating. To the chromium plating trough 11, a plating solution composing the aforementioned hexavalent chromium bath or trivalent chromium bath is added, and a metal substrate 17 which is to receive chromium plating is used as a cathode. Since chromium plating is to be performed while supplying chromium ions from the plating solution, an insoluble anode 18 which does not dissolve in a chromium plating solution is used as an anode.

Next, the DC power source 19 is connected between the electrodes, and power is supplied therefrom. The chromium ions contained in the chromium plating solution move toward the cathode side, i.e., the metal substrate 17, where the ions are reduced to metal Cr and deposit.

In order to form a chromium plating layer of about 0.3 μm or more in a region which is to be heated to a temperature of about 350° C. or above in a preferred embodiment of the present invention, the plating is preferably performed while placing the metal substrate in a position which will allow a desired chromium plating layer to be obtained. In particular, in the case where a metal substrate such as a curved exhaust pipe is to be plated, it is preferable to arrange and locate the metal substrate so that the distance between the electrode (anode) and the material to be plated (metal substrate) is as short as possible.

Figure 8A:
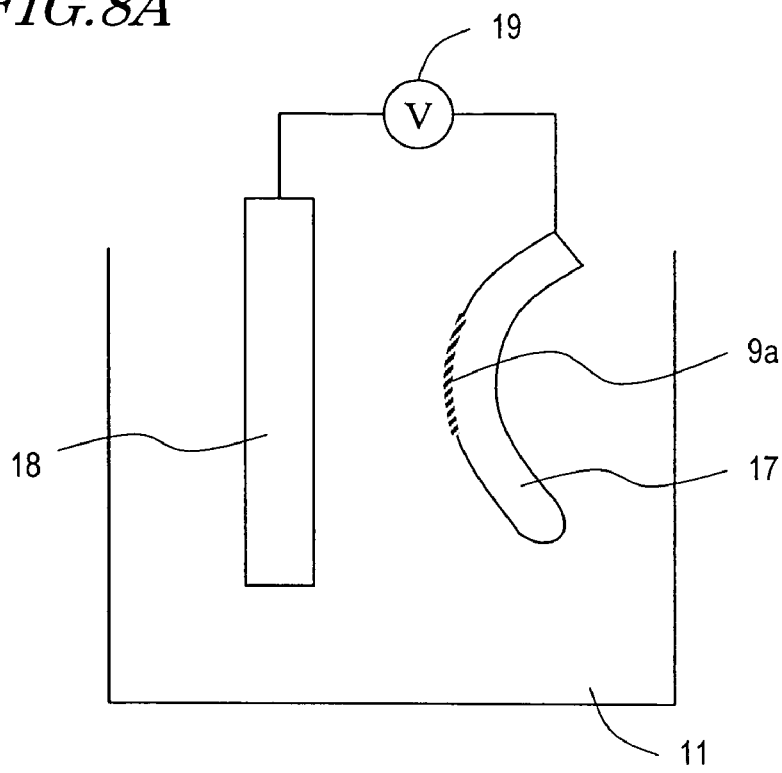
FIG. 8A is a diagram schematically showing an arrangement in which a minimum distance exists between a curved portion of a metal substrate and an electrode.

For example, as shown in FIG. 8A, if the metal substrate 17 is arranged so that the distance between the metal substrate 17 and the electrode 18 becomes smallest near the convex portion 9*a* of the bent portion of the metal substrate 17, a Cr layer can be efficiently formed at the convex portion 9*a*, which will be heated to a high temperature.

Figure 8B:
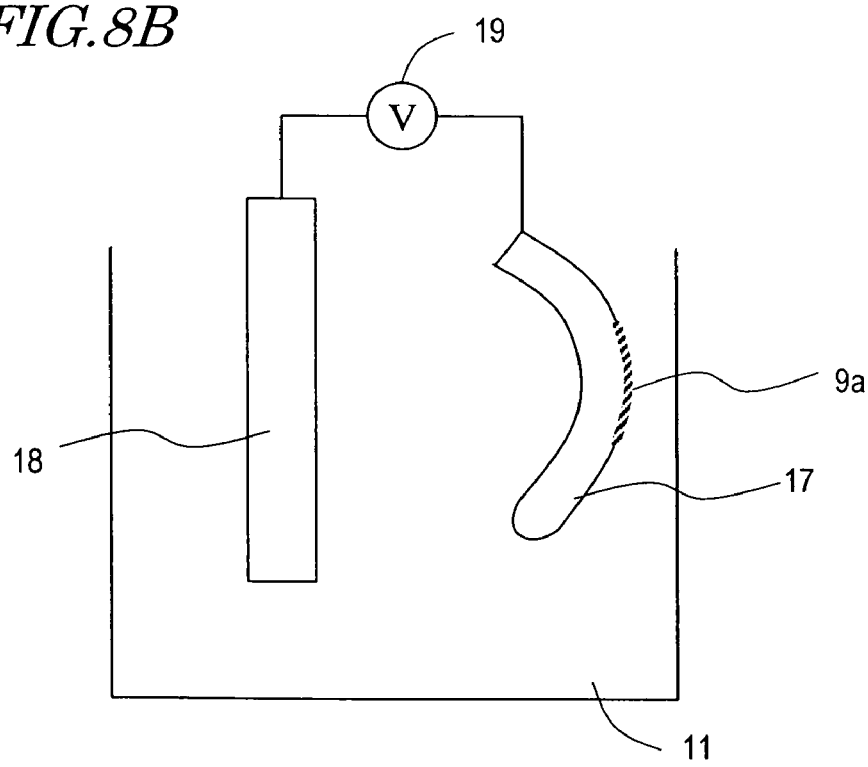
FIG. 8B is a diagram schematically showing an arrangement in which a long distance exists between a curved portion of a metal substrate and an electrode.

On the other hand, as shown in FIG. 8B, if the metal substrate 17 is arranged so that a longitudinal exists between the convex portion 9*a* of the bent portion of the metal substrate 17 and the electrode 18, a chromium plating layer is likely to be formed at the concave portion opposite from the convex portion 9*a*, and not at the convex portion 9*a* itself, thus resulting in a poor plating efficiency.

Otherwise, by controlling the amount of charge (current× time) traveling through the electrode surface, current density, or the like, for example, the thickness of the chromium plating layer can be controlled to be within a predetermined range. In particular, the electrode positioning may be controlled, or an auxiliary electrode may be attached to control the current density or the like, for example, thus making it easier to form a predetermined chromium plating layer in regions which are to be heated to a temperature of about 350° C. or above. In the specific controlling method, appropriate conditions may be selected according to the type and shape of the metal substrate which is used, the constitution of the plating bath, the thickness of the chromium plating layer, or the like. After plating, the chromium plating layer has a surface roughness (Ra) of about 1 μm or less, and preferably has a surface roughness (Ra) of about 0.2 μm or less. Thus, the chromium plating layer has a sufficient brightness withough further sruface finishing process.

In the case where a chromium plating layer is formed by using trivalent chromium, it is preferable to reduce the Fe content in the chromium plating layer as much as possible. As a result, a silver-gray color similar to that which is obtained by using hexavalent chromium can be obtained. Therefore, according to preferred embodiments of the present invention, no additive which contains Fe as a component (e.g., ferrous sulfate) is added to the trivalent chromium plating bath. In order to improve the throwing power and the like of the plating layer, usually about 0.0001 mass % to about 0.0003 mass % ferrous sulfate is added to the trivalent chromium plating bath, so that about 2 mass % to about 20 mass % Fe is contained in the resultant chromium plating layer. On the other hand, in a trivalent chromium bath used in preferred embodiments of the present invention, no ferrous sulfate (which would serve as an Fe source) is added, so that the chromium plating layer contains substantially no Fe.

Note that, in the case where no ferrous sulfate is added to the chromium plating bath, there may be a problem in that the throwing power of the plating layer may be become poor, for example. However, this problem can be solved by, for example, the aforementioned method of controlling the electrode position so as to achieve a uniform current density, or other methods.

On the other hand, as plating progresses, various metal cations such as Fe ions and/or Cu ions may stray into the plating solution. For example, in the case where chromium plating is performed by using an Fe substrate, Fe may be dissolved from the Fe substrate and diffuse into the chromium plating layer. Even in the case where an Fe substrate is not used, there may be cases where Fe gathers toward the chromium plating layer side for inevitable reasons. Such dissolution of Fe is a phenomenon which is observed irrespective of the presence or absence of ferrous sulfate, and is particularly outstanding in the case where a thick chromium plating layer is formed, as in a preferred embodiment of the present invention. Therefore, in order to control the Fe content, it is not sufficient to merely control the composition of the chromium plating bath, but it is also necessary to regularly monitor the Fe content which strays into the chromium plating bath from the Fe substrate or the like, and to remove the Fe content.

The Fe ions which stray into the plating solution are to be removed by using the ion exchange apparatus 16, which includes a cation exchange resin. The cation exchange resin to be used for preferred embodiments of the present invention may be any resin that permits easy exchange with divalent metal cations such as Fe, without any particular limitations.

The specific removal method may be as follows. First, during the plating, the plating solution is regularly pumped up from the plating trough 11 by using the pump 12, and suspended matter is removed by using the percolator 13. Next, the plating solution from which the suspended matter has been removed is introduced into the ion exchange apparatus 16, while adjusting the flow rate via the adjustment valve 14, and metal cations such as Fe ions are removed by using the cation exchange resin. The flow rate of the plating solution is monitored with the flowmeter 15. The plating solution which has been processed by the ion exchange apparatus 16 is regularly collected in order to check for Fe concentration. In order to reduce the Fe concentration within the chromium plating layer to about 2 mass % or less as in preferred embodiments of the present invention, it is necessary to control the Fe concentration in the plating solution to be about 0.0001 mass % or less. Thus, removal by the ion exchange apparatus 16 is performed until the aforementioned range is satisfied.

The plating solution (recovered plating solution) from which Fe ions are thus removed exits the outlet of the ion exchange apparatus 16, and is led through the tube path 24, thus to be circulated to the plating trough 11. The recovered plating solution may be stored in an appropriate storage container (not shown), for example.

Note that a technique of removing metal cations within a plating solution by using the ion exchange apparatus 16 is specifically described in Japanese Patent No. 3073789, for example, and such a technique is applicable to the method of a preferred embodiment of the present invention. Moreover, various alterations thereof have also been proposed (e.g., Japanese Laid-Open Patent Publication No. 9-228069), which are also applicable to the method of preferred embodiments of the present invention.

7. Experimental Example

In this experimental example, the relationship between the thickness of the chromium plating layer and discoloration due to heating, as well as relationship between the Fe content in the chromium plating layer and surface color tone and cracks, were examined with respect to an engine part according to a preferred embodiment of the present invention.

First, metal tubes composed of STKM were prepared, and a nickel plating layer composed of a semigloss nickel plating layer, a tri-nickel plating layer, and a gloss nickel plating layer was formed by the following method. The compositions of the plating baths used for forming these plating layers are shown in Table 1. Note that the C and/or S contained in the tri-nickel plating bath was supplied from an additive other than a brightener.

TABLE 1

| Semigloss Nickel | | Tri-Nickel | | Gloss Nickel | |
|---|---|---|---|---|---|
| Nickel Sulfate | 200~260 g/l | Nickel Sulfate | 180~230 g/l | Nickel Sulfate | 200~400 g/l |
| Nickel Chloride | 30~60 g/l | Nickel Chloride | 30~60 g/l | Nickel Chloride | 30~60 g/l |
| Boric Acid | 35~60 g/l | Boric Acid | 35~60 g/l | Boric Acid | 35~60 g/l |
| Brightener | Added | Brightener | None | Brightener | Added |
| Amounts of C and S | 0.001% | Amounts of C and S | 0.1~0.2% | Amounts of C and S | 0.005% |
| pH | 4.0~4.4 | pH | 2.0~2.4 | pH | 4.0~4.4 |

Semigloss nickel plating layer (thickness: about 5 μm to about 15 μm)

plating conditions: power was supplied at about 10V to about 12V (volts), about 1800 A to about 2800 A (amperes).

Tri-nickel plating layer (thickness: about 1 μm to about 5 μm)

plating conditions: power was supplied at about 3V to about 3.5V, about 20 A to about 40 A.

Gloss nickel plating layer (thickness: about 5 μm to about 15 μm)— plating conditions: power was supplied at about 10V to about 12V, about 1800 A to about 2800 A.

Figure 7:
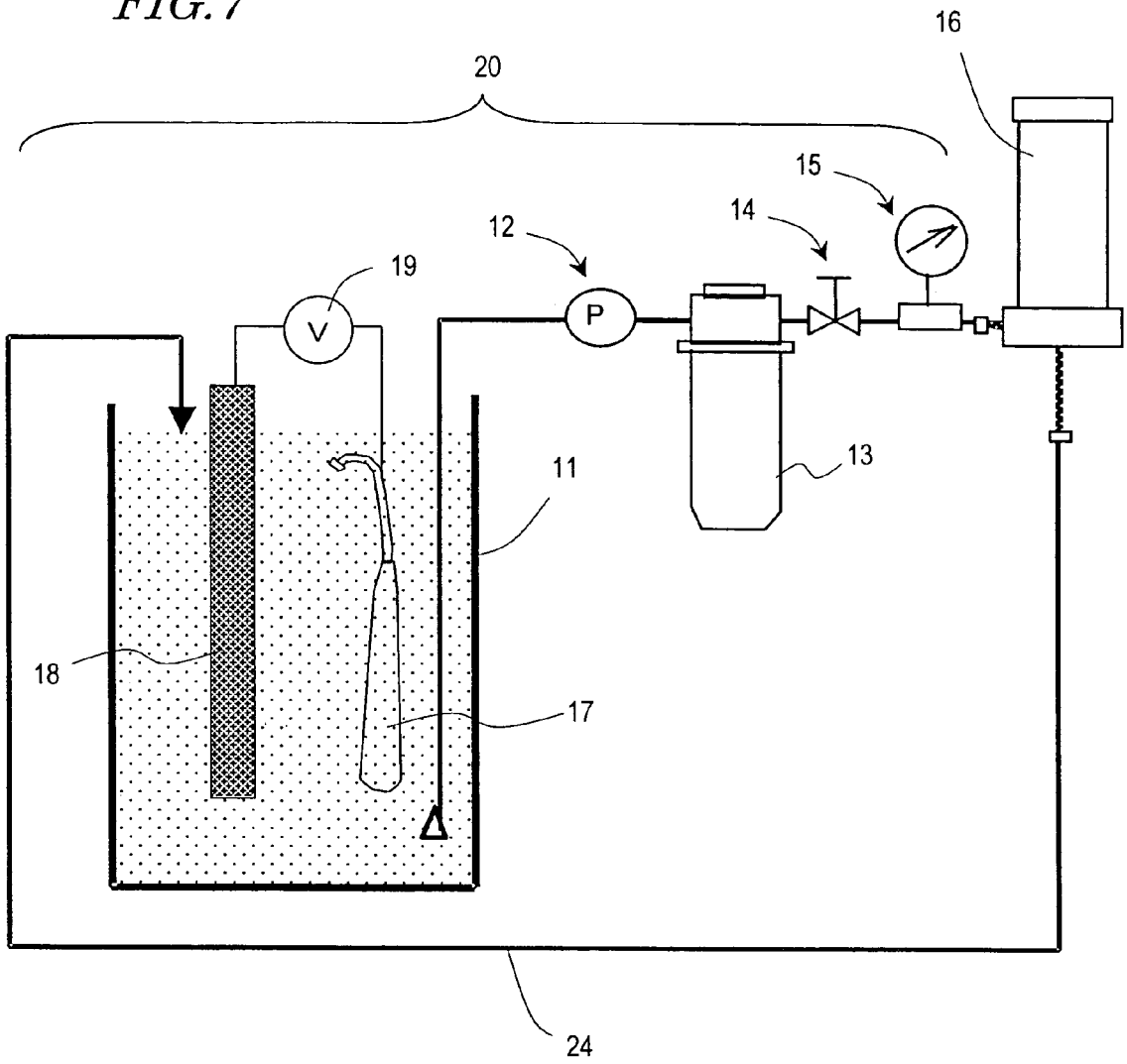
FIG. 7 is a diagram showing an example of a chromium plating apparatus used in a preferred embodiment of the present invention.

Next, by using a chromium plating apparatus having an ion exchange apparatus as shown in FIG. 7, a chromium plating layer was formed on the intermediate plating layer. As the chromium plating bath, a hexavalent chromium plating bath as described in Table 2, and two types of trivalent chromium plating baths as described in Table 3 were used. Among the trivalent chromium plating baths described in Table 3, "present invention" is an example where no ferrous sulfate was added to the plating bath, whereas "conventional example" is an example where ferrous sulfate was contained in the plating bath.

TABLE 2

| Bath Component | Chemical Formula | Sargent's Bath |
|---|---|---|
| Chromic Anhydride | $CrO_3$ | 190~250 g/l |
| Sulfuric Acid | $H_2SO_4$ | 2.5 g/l |
| Sodium Silicofluoride | $Na_2SiF_6$ | — |

TABLE 3

| Bath Component | Chemical Formula | Conventional Example | Present Invention |
|---|---|---|---|
| Basic Chromium Sulfate | $Cr(OH)SO_4$ | 95~115 g/l | 95~115 g/l |
| Boric Acid | $H_3BO_3$ | 63 g/l | 63 g/l |
| Ammonium Formate | $HCOONH_4$ | 200 g/l | 200 g/l |
| Surfactant | Sodium Sulfosuccinate 2-Ethylhexyl Sodium Sulfate | 6.5 mg/l | 6.5 mg/l |
| Ferrous Sulfate | $FeSO_4.7H_2O$ | 0.3 mg/l | — |

The thickness of the chromium plating layer was varied in the range from about 0.05 μm to about 1 μm, by changing the plating time in the range from about 5 to 20 minutes.

The Fe ions which strayed into the plating were removed by using an ion exchange apparatus having a cation exchange resin. Specifically, a plating solution was regularly fed to the ion exchange apparatus, and the Fe concentration within the plating solution was controlled to be within the range from 0 to about 0.0001 mass %. The Fe concentration in the chromium plating layer of each sample thus obtained is shown in Table 4.

TABLE 4

| | Fe Content in Cr Plating Layer (mass %) |
|---|---|
| Hexavalent Chromium | 0.5% |
| Trivalent Chromium (Conventional Example) | 15% |
| Trivalent Chromium (Present Invention) | 1.0% |

With respect to each sample, the color tone and luster immediately after plating were measured by the following methods, and evaluated according to the following standards.

Color Tone Immediately After Plating

By using a spectrometric color difference meter (color analyzer TC-1800MK-II (Tokyo Denshoku)), the L* value, a* value, and b* value were measured according to the method described in CIE 1976, and visual inspections were also made.

Evaluation Standards (◎, ○, and Δ correspond to the present invention):

◎: A color tone similar to that which is obtained by using hexavalent chromium is obtained.
(72≦L* value≦80)

○: A color tone similar to that which is obtained by using hexavalent chromium is obtained, with a slightly lower metallic luster.
(68≦L* value≦72)

Δ: A slightly blackish color tone is obtained.
(65≦L*value≦68)

X: A blackish color tone is obtained.
(L*value≦65)

Luster

By using a spectrometric color difference meter (color analyzer TC-1800MK-II (Tokyo Denshoku)), the L* value, a* value, and b* value were measured according to the method described in CIE 1976, and visual inspections were also made.

Evaluation Standards (◎, ○, and Δ correspond to the present invention):

◎: A substantially mirror-finish luster is obtained.

○: A luster close to mirror finish is obtained.

Δ: Luster slightly decreases.

X: Luster decreases, with a clouded impression.

Next, each sample was placed in an atmospheric furnace, and after being heated under the conditions of approximately 500° C.×8 hours, the degree of thermal discoloration and occurrence of cracks due to heating were measured by the following methods, and evaluated according to the following standards.

Thermal Discoloration

Measurement method: By using a spectrometric color difference meter (color analyzer TC-1800MK-II (Tokyo Denshoku)), the L* value, a* value, and b* value were measured, before and after heating, according to the method described in CIE 1976. The values before heating are labeled as "L0* value", "a0* value", and "b0* value", whereas the values after heating are labeled as "L1* value", "a1* value", and "b1* value". Thus, a color difference ΔE* value after heating was measured as follows.

$$\Delta E*\text{value} = \sqrt{\begin{array}{l}(L_1*\text{value} - L_0*\text{value})^2 + \\ (a_1*\text{value} - a_0*\text{value})^2 + \\ (b_1*\text{value} - b_0*\text{value})^2\end{array}} \quad \text{Equation 1}$$

Evaluation Standards (◎, ○, and Δ correspond to the present invention):

◎: ΔE* value<1

○: 1≦ΔE* value<3

Δ: 3≦ΔE* value<4

X: 4≦ΔE* value

Cracks

Measurement method: By using an optical microscope (magnification: ×400), cracks occurring in the chromium plating layer surface (about 10 mm×10 mm) were observed.

Evaluation Standards (◎, ○, and Δ correspond to the present invention):

◎: There are no cracks.

○: A few discontinuous cracks are observed.

Δ: A few continuous cracks have occurred.

X: A large number of continuous cracks have occurred.

These results are summarized in Table 5.

TABLE 5

| | Film Thickness (μm) | 0.05 | 0.10 | 0.15 | 0.20 | 0.25 | 0.30 | 0.40 | 0.50 | 0.60 | 0.70 | 0.80 | 0.90 | 1.00 |
|---|---|---|---|---|---|---|---|---|---|---|---|---|---|---|
| Hexavalent Chromium | Cracks | ◎ | ◎ | ◎ | ◎ | ◎ | ◎ | ◎ | ◎ | ◎ | ◎ | Δ | Δ | X |
| | ColorTone | X | ◎ | ◎ | ◎ | ◎ | ◎ | ◎ | ◎ | ◎ | ◎ | ○ | ○ | ○ |
| | Luster | Δ | ◎ | ◎ | ◎ | ◎ | ◎ | ◎ | ◎ | ◎ | ○ | Δ | Δ | X |
| | Thermal Discoloration | X | X | X | Δ | Δ | ○ | ◎ | ◎ | ◎ | ◎ | ◎ | ◎ | ◎ |

TABLE 5-continued

| | Film Thickness (μm) | 0.05 | 0.10 | 0.15 | 0.20 | 0.25 | 0.30 | 0.40 | 0.50 | 0.60 | 0.70 | 0.80 | 0.90 | 1.00 |
|---|---|---|---|---|---|---|---|---|---|---|---|---|---|---|
| Trivalent Chromium (Conventional Example) | Cracks | ◎ | ◎ | ◎ | ○ | ○ | Δ | X | X | X | X | X | X | X |
| | ColorTone | X | X | X | X | X | X | X | X | X | X | X | X | X |
| | Luster | Δ | ◎ | ◎ | ◎ | ◎ | ◎ | ○ | Δ | X | X | X | X | X |
| | Thermal Discoloration | X | X | X | Δ | Δ | ○ | ◎ | ◎ | ◎ | ◎ | ◎ | ◎ | ◎ |
| Trivalent Chromium (Present Invention) | Cracks | ◎ | ◎ | ◎ | ◎ | ◎ | ◎ | ◎ | ○ | Δ | X | X | X | X |
| | ColorTone | X | ◎ | ◎ | ◎ | ◎ | ◎ | ◎ | ◎ | ◎ | ◎ | ○ | ○ | ○ |
| | Luster | Δ | ◎ | ◎ | ◎ | ◎ | ◎ | ◎ | ◎ | ○ | Δ | X | X | X |
| | Thermal Discoloration | X | X | X | Δ | Δ | ○ | ◎ | ◎ | ◎ | ◎ | ◎ | ◎ | ◎ |

As shown in Table 5, by controlling the thickness of the chromium plating layer to be about 0.2 μm or more, thermal discoloration due to heating can be effectively prevented. These results were similar irrespective of whether trivalent chromium was used or hexavalent chromium was used. However, luster decreased and cracks occurred with an increase in the thickness of the chromium plating layer. More cracks were observed in the case of using a conventional trivalent chromium plating bath (containing ferrous sulfate) than in the case of using the trivalent chromium plating bath (containing no ferrous sulfate) according to the example of preferred embodiments of the present invention. On the whole, these results indicate that, when using hexavalent chromium, it is preferable to control the thickness of the chromium plating layer to be about 0.9 μm or less (and more preferably about 0.6 μm or less). On the other hand, when using trivalent chromium, it is preferable to control the thickness of the chromium plating layer to be about 0.5 μm or less.

In addition, when a chromium plating layer was formed by using trivalent chromium, a color tone similar to that which is obtained by using hexavalent chromium was obtained by reducing the Fe concentration in the chromium plating layer down to a predetermined range through the use of the trivalent chromium plating bath according to the example of preferred embodiments of the present invention. Such improvements in color tone were observed with respect to any chromium plating layer having a thickness in the range from about 0.1 μm to about 0.7 μm.

Figure 9A:
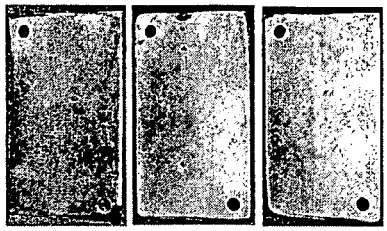
FIG. 9A indicates photographs each showing a chromium plating layer formed by using a trivalent chromium plating bath which contains no ferrous sulfate, the chromium plating layer having been heated.
Figure 9B:
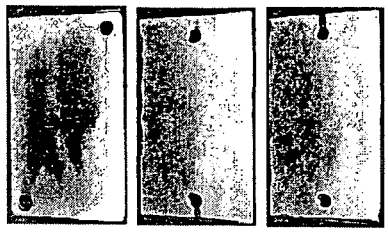
FIG. 9B indicates photographs each showing a chromium plating layer formed by using a conventional trivalent chromium plating bath which contains ferrous sulfate, the chromium plating layer having been heated.

FIGS. 9A and 9B indicate photographs of samples having chromium plating layers of different thicknesses, each photograph showing surface discoloration of the chromium plating after being heated at about 500° C. for approximately 8 hours. In both FIGS. 9A and 9B, the thickness of the chromium plating layer increases as follows, from left to right: 0.1 μm (comparative example); about 0.3 μm (present invention); and about 0.5 μm (present invention).

FIG. 9A indicates photographs each showing a chromium plating layer with a reduced Fe content, obtained by using a trivalent chromium plating bath which contains no ferrous sulfate, the chromium plating layer having been heated. FIG. 9B indicates photographs each showing a chromium plating layer formed by using a conventional trivalent chromium plating bath which contains ferrous sulfate, the chromium plating layer having been heated. In either case, it can be clearly seen that, thermal discoloration due to heating is prevented by controlling the thickness of the chromium plating layer to be about 0.3 μm or more.

From the above experimental results, it has been confirmed that thermal discoloration due to a high-temperature exhaust gas can be prevented by prescribing the thickness of a chromium plating layer to be about 0.3 μm or more, irrespective of the type of Cr used in the formation of the chromium plating layer. It has also been confirmed that, in the case of forming a chromium plating layer by using trivalent chromium, a color tone similar to that which is obtained by using hexavalent chromium can be obtained by reducing the Fe concentration in the chromium plating layer.

The present invention is broadly applicable to a vehicle having an engine (e.g., a motorcycle or an all-terrain four-wheeled vehicle) and a transportation apparatus having an engine (e.g., a ship or an airplane).

This application is based on Japanese Patent Applications Nos. 2004-230439 filed Aug. 6, 2004 and 2005-222943 filed Aug. 1, 2005, the entire contents of which are hereby incorporated by reference.

While the present invention has been described with respect to preferred embodiments thereof, it will be apparent to those skilled in the art that the disclosed invention may be modified in numerous ways and may assume many embodiments other than those specifically described above. Accordingly, it is intended by the appended claims to cover all modifications of the invention that fall within the true spirit and scope of the invention.

What is claimed is:

1. An engine part comprising:

a metal substrate;

a chromium plating layer covering at least a region of a surface of the metal substrate, the region being heated to a temperature of about 350° C. or more; and an intermediate plating layer provided between the metal substrate and the chromium plating layer; wherein the chromium plating layer has a thickness in a range from about 0.2 μm to about 0.9 μm in the region;

the chromium plating layer includes decorative chromium plating; and the intermediate plating player includes at least one of C and S.

2. The engine part of claim 1, wherein the chromium plating layer has a thickness in a range from about 0.2 μm to about 0.5 μm in the region.

3. The engine part of claim 1, wherein the metal substrate is a metal tube defining a passage through which an exhaust gas from an engine travels.

4. The engine part of claim 3, wherein the chromium plating layer covers an outer side surface of the metal tube.

5. The engine part of claim 4, wherein, the metal tube has a bent portion; and the region is a convex surface defined by the bent portion.

6. The engine part of claim 4, wherein, the metal tube includes a manifold section having a plurality of branch pipes connected thereto; and the region is an outer surface of the manifold section.

7. The engine part of claim 4, wherein, the metal tube has a catalyst accommodating section accommodating a catalytic apparatus arranged to decompose at least one component in the exhaust gas;

the region is an outer surface of the catalyst accommodating section.

8. The engine part of claim 1 wherein the intermediate plating layer further includes Ni.

9. The engine part of claim 1, wherein the intermediate plating layer includes a metal having a hardness lower than that of a type of Cr composing the chromium plating layer.

10. The engine part of claim 1, wherein the intermediate plating layer includes nickel plating.

11. The engine part of claim 1, wherein the metal substrate includes a material containing Fe, Al, Zn, Mg, or Ti as a main component.

12. The engine part of claim 1, wherein the chromium plating layer is formed by using a hexavalent chromium plating bath.

13. The engine part of claim 1, wherein the chromium plating layer is formed by using a trivalent chromium plating bath.

14. An engine part comprising:

a metal substrate;

a chromium plating layer covering at least a portion of a surface of the metal substrate; and an intermediate plating layer provided between the metal substrate and the chromium plating layer; wherein a type of Cr composing the chromium plating layer substantially has an amorphous structure, and an Fe content in the chromium plating layer is about 2 mass % or less;

the chromium plating layer covers a region of the surface of the metal substrate, the region being heated to a temperature of about 350° C. or more, and the chromium plating layer has a thickness in a range from about 0.2 μm to about 0.6 μm in the region:

the chromium plating layer includes decorative chromium plating; and the intermediate plating layer includes at least one of C and S.

15. The engine part of claim 14, wherein the chromium plating layer has a color tone such that an L* value measured according to CIE (Commision Internationale de l'Eclairage) 1976 is in a range from 68 to 80.

16. The engine part of claim 14, wherein the metal substrate is a metal tube defining a passage through which an exhaust gas from an engine travels.

17. The engine part of claim 16, wherein the chromium plating layer covers at least a portion of an outer side surface of the metal tube.

18. The engine part of claim 17, wherein, the metal tube has a bent portion; and the region is a convex surface defined by the bent portion.

19. The engine part of claim 17, wherein the metal tube includes a manifold section having a plurality of branch pipes connected thereto; and the region is an outer surface of the manifold section.

20. The engine part of claim 17, wherein, the metal tube has a catalyst accommodating section accommodating a catalytic apparatus for decomposing at least one component in the exhaust gas;

the region is an outer surface of the catalyst accommodating section.

21. The engine part of claim 14, wherein the intermediate plating layer further includes Ni.

22. The engine part of claim 14, wherein the intermediate plating layer includes a metal having a hardness lower than that of a type of Cr composing the chromium plating layer.

23. The engine part of claim 14, wherein the intermediate plating layer includes nickel plating.

24. The engine part of claim 14, wherein the metal substrate includes a material containing Fe, Al, Zn, Mg, or Ti as a main component.

25. An exhaust pipe comprising:

a metal tube having a bent portion;

a decorative chromium plating layer arranged so as to cover at least an outer convex surface being defined by a portion of the bent portion, the decorative chromium plating layer having a thickness in a range from about 0.2 μm to about 0.5 μm; and an intermediate plating layer provided between the bent portion and the decorative chromium plating layer; wherein the intermediate plating layer includes at least one of C and S.

26. The exhaust pipe of claim 25, wherein, the metal tube includes a manifold section having a plurality of branch pipes connected thereto, and a catalyst accommodating section accommodating a catalytic apparatus; and the decorative chromium plating layer further covers an outside of the manifold section and the catalyst accommodating section.

27. The exhaust pipe of claims 25, wherein the chromium plating layer has a color tone such that an L* value measured according to CIE (Commision Internationale de l'Eclairage) 1976 is in a range from 68 to 80.

28. An engine comprising the engine part of claim 1.

29. An engine comprising the engine part of claim 14.

30. A transportation apparatus comprising the exhaust pipe of claim 25.

* * * * *